United States Patent [19]

Urmston

[11] 3,990,699

[45] Nov. 9, 1976

[54] GAME BAT

[76] Inventor: Robert E. Urmston, 4405 Niagara Ave., San Diego, Calif. 92107

[22] Filed: Mar. 28, 1975

[21] Appl. No.: 562,832

[52] U.S. Cl. ..... 273/67 B

[51] Int. Cl.[2] ..... A63B 59/18

[58] Field of Search ..... 273/67 R, 67 B, 72 R, 273/73 R, 76, 95 R, 95 A, 96 R, 167 R, 167 C, 175, 84; 272/76, 84; 2/16, 18, 158–161 R, 161 A; 280/11.37 H; 128/77, 91, 57

[56] References Cited

UNITED STATES PATENTS

| | | | |
|---|---|---|---|
| 113,966 | 4/1871 | Ballou | 272/84 |
| 771,247 | 10/1904 | Hillerich | 273/72 R |
| 1,930,281 | 10/1933 | Ogden | 273/67 R |
| 2,191,287 | 2/1940 | Perryman | 273/76 |
| 2,328,366 | 8/1943 | Timmermann | 273/76 |
| 2,935,321 | 5/1960 | Lhotka | 273/67 R |
| 2,987,316 | 6/1961 | Butera | 273/67 B |
| 3,185,476 | 5/1965 | Fechner | 2/18 X |
| 3,404,409 | 10/1968 | Tillotson et al. | 2/161 R |
| 3,674,270 | 7/1972 | Benjamin et al. | 273/67 R X |
| 3,746,356 | 7/1973 | Shipstad | 2/16 X |
| 3,759,527 | 9/1973 | Witherspoon | 273/167 C X |
| 3,776,551 | 12/1973 | Schaller et al. | 273/67 R X |
| 3,802,009 | 4/1974 | Clemente | 273/67 B X |
| 3,874,686 | 4/1975 | Shipstad | 2/16 X |

FOREIGN PATENTS OR APPLICATIONS

| | | | |
|---|---|---|---|
| 156,982 | 9/1939 | Germany | 273/67 B |
| 1,573 | 1/1902 | United Kingdom | 273/76 |

*Primary Examiner*—Richard J. Apley
*Attorney, Agent, or Firm*—Ralph S. Branscomb

[57] ABSTRACT

The invention comprises a hand-held bat to be used in any game of the player's choosing in which a ball, shuttlecock or the like is batted back and forth among two or more players. The bat comprises a rigid sheath having an interiorly mounted hand hold to be gripped by the player, and a frictional external surface on the sheath enabling the player to more fully control, and impart spin to the ball.

3 Claims, 7 Drawing Figures

GAME BAT

BACKGROUND OF THE INVENTION

The invention relates to games in which a ball or other object is struck with a bat, racket or the like, such as tennis, baseball, and badminton, and more particularly to the bats or rackets used in these games. These devices are almost uniformly held by a handle projecting from the batting or striking portion, and there is no bat in the prior art which is gripped by the player inside the striking faces and which can be used to strike the ball on any available surface of the bat without producing an unpredictable ball trajectory.

SUMMARY OF THE INVENTION

The bat of the present invention is different from the variety of bats and rackets used in the prior art in that it comprises a generally cylindrical, ovate, or spherical rigid sheath which is gripped by a hand hold inside the sheath so that a ball or the like may be struck adjacent the hand or forearm area of the player on any side of the bat.

A plurality of the bats would normally be used concurrently with a like number of players, the ball being simply bounced back and forth among the players, or a net may be used with tennis or badminton rules being observed, or any rules and method of play may be conceived to suit the fancy of the players.

DETAILED DESCRIPTION OF THE PREFERRED EMBODIMENT

Figure 5:
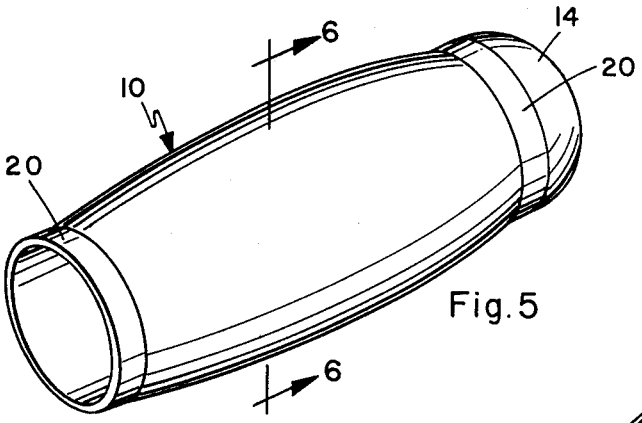
FIG. 5 is a perspective view of an alternative exterior configuration.
Figure 6:
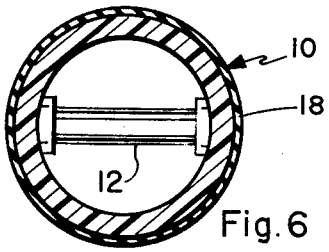
FIG. 6 is a sectional view taken on line 6—6 of FIG. 5.

The bat is constructed of two basic parts, an elongated sheath 10 and a hand grip 12 mounted between the inner walls of the sheath. Both of these parts should be fairly rigid, and may be constructed of wood, hard plastic, or any other suitable material. The sheath may be generally cylindrical, as shown in FIGS. 1–4, or somewhat ovate longitudinally as shown in FIGS. 5 and 6. In either case a dome-shaped cap of similar construction may be mounted on one end of the sheath in any suitable fashion so that the ball used in play may be struck by the end of the bat, although quite satisfactory results are achieved by omitting the dome so that the sheath is open at both ends.

Figure 7:
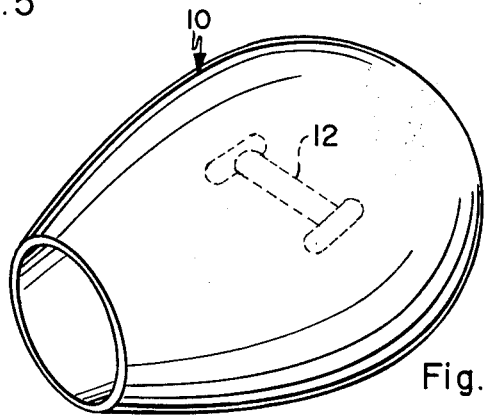
FIG. 7 is a perspective view of a further external configuration.

The bat may also take the varient form illustrated in FIG. 7, in which the sheath is at least partially spherical, or spheroidal. In this variation as well as the other embodiments shown the sheath is consistently circular in laterial cross section, although a sheath of flattened or oval cross section could be used and perhaps would be advantageous in some circumstances.

The exterior surface of the sheath, as well as the end cap, is preferably provided in one way or another with a frictional surface to increase the player's ability to control the ball. In the embodiment in FIGS. 1–4, this frictional surface is provided as a series of nodules 16 formed by relieving the surface in an annular and longitudinal groove pattern, the grooves being routed into wood or molded in plastic. Alternatively, a coating 18 of rubber or other frictional substance could be attached in sheet form, or spirally wound strip form, or applied directly to the smooth exterior surface of the sheath as shown in FIG. 6. Other grooved, ridged, knurled, or coated surfaces are clearly conceivable which would satisfactorily increase the frictional quality of the sheath and perhaps be ornamental as well.

A pair of decorative bands 20 may be provided at the ends of the sheath, a configuration which is especially attractive if the sheath is fashioned in dark stained wood and the bands are brass. The band adjacent the end cap 14 may also be of some utility in retaining the cap in position.

Figure 1:
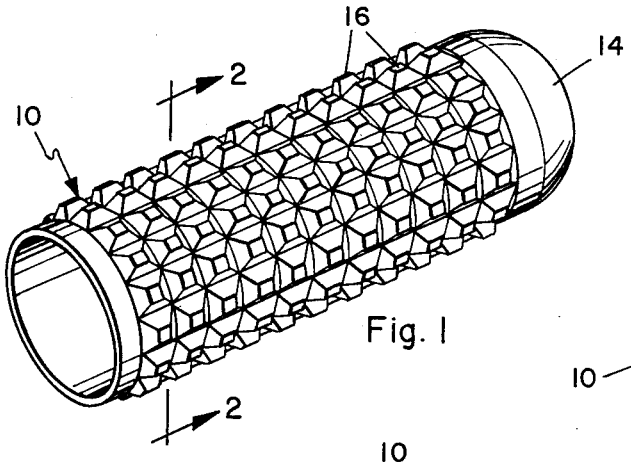
FIG. 1 is a perspective view of the bat.
Figure 2:
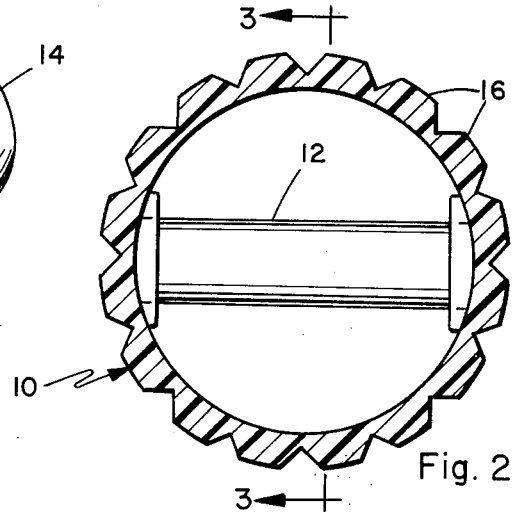
FIG. 2 is an enlarged sectional view taken on line 2—2 of FIG. 1.

The hand grip 12 may be a rigid member spanning the interior of the sheath and mounted to the opposite sides thereof as in FIG. 2. Contours may be provided in the hand grip to conform to the shape of the hand in conventional fashion. In an alternative embodiment of the hand grip shown in FIG. 4 a flexible member 22 such as a rope may be extended fairly tautly through a pair of opposed openings and retained by knots. The rope handle would have an advantage of easy replacement in the event of breakage or loosening.

Figure 3:
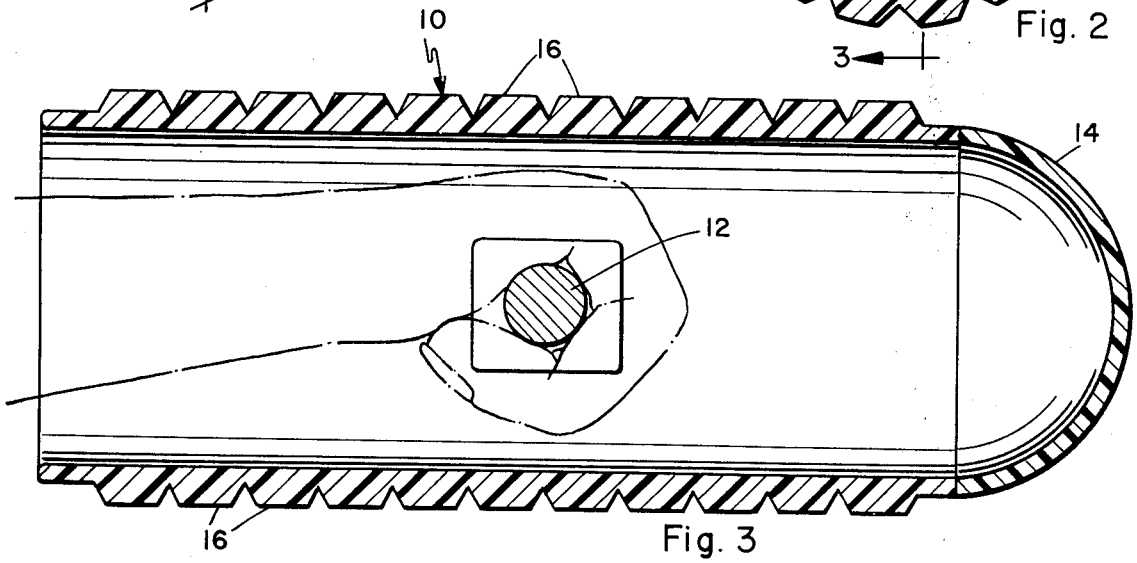
FIG. 3 is a sectional view taken on line 3—3 of FIG. 2.
Figure 4:
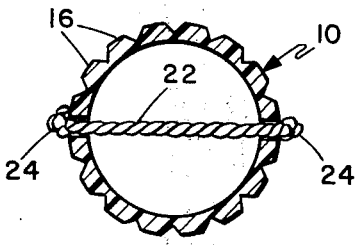
FIG. 4 is a sectional view similar to FIG. 2, on a reduced scale, showing an alternative handle.

The embodiment shown in FIGS. 5 and 6 utilizes a handle 12 similar to that illustrated in FIG. 3, although clearly a handle of rope or other flexible material as shown in FIG. 4 could be utilized as well. As indicated in dotted line in FIG. 7, this embodiment also is provided with a rigid handle 12 although the same proviso regarding a rope handle applies.

In use, the player of course inserts his arm into the open end of the sheath and grips the hand grip 12. Two or more players are normally involved in the play, which may involve simple batting a ball to and fro among the players. It has been found that youthful players using a ball similar in resilience to a volley ball but of about the diameter of the sheath, can entertain themselves quite contentedly for extended periods of time with the bats.

I claim:

1. A hand-held bat for use in batting balls and the like in games, comprising:

a. a rigid elongated sheath being generally circular in lateral cross section and being completely enclosed in the lateral direction and having at least one open end dimensioned to receive the hand and a portion of the forearm of a player;

b. a hand grip mounted substantially crosswise within said sheath to be be gripped by the hand of a player; and c. said sheath having a frictional external surface comprising a plurality of distinct spaced nodules formed in, and substantially covering, said sheath.

2. A hand-held bat for use in batting balls and the like in games, comprising:

a. a rigid elongated sheath being generally circular in lateral cross section and being completely enclosed in the lateral direction and having at least one open end dimensioned to receive the hand and a portion of the forearm of a player;

b. a hand grip mounted substantially crosswise within said sheath to be gripped by the hand of a player; and c. the end of said sheath opposite said open end having an outwardly convex cap mounted thereto to increase the operative surface area of said bat.

3. A hand-held bat for use in batting balls and the like in games, comprising:

a. a rigid elongated sheath being generally circular in lateral cross section and being completely enclosed in the lateral direction and having at least one open end dimensioned to receive the hand and a portion of the forearm of a player;

b. a hand grip mounted substantially crosswise within said sheath to be gripped by the hand of a player; and c. said hand grip having an elongated laterally extended flexible member secured to generally opposite sides of said sheath and spanning the interior thereof.

* * * * *